US005315492A

United States Patent [19]

Davenport

[11] Patent Number: 5,315,492

[45] Date of Patent: May 24, 1994

[54] ILLUMINATED WINDOW DISPLAY ORNAMENT

[76] Inventor: Donald J. Davenport, P.O. Box 278, Troy, Mich. 48099

[21] Appl. No.: 52,471

[22] Filed: Apr. 23, 1993

[51] Int. Cl.[5] ..... F21P 1/02

[52] U.S. Cl. ..... 362/122; 362/157; 362/397; 362/800; 362/806

[58] Field of Search ..... 362/80.1, 122, 123, 362/157, 190, 227, 184, 249, 397, 392, 800, 806, 810

[56] References Cited

U.S. PATENT DOCUMENTS

| | | | |
|---|---|---|---|
| 2,052,425 | 8/1936 | Simeone | 362/397 |
| 2,753,441 | 7/1956 | Kuykendall | 362/122 |
| 2,761,233 | 9/1956 | Brown | 362/122 |
| 3,350,555 | 10/1967 | Rico | 362/122 |
| 3,500,035 | 3/1970 | Frank | 362/122 |
| 5,016,145 | 5/1991 | Singleton | 362/80.1 |
| 5,110,078 | 5/1992 | Gary | 362/249 |

*Primary Examiner*—Richard R. Cole
*Attorney, Agent, or Firm*—John R. Benefiel

[57] ABSTRACT

An illuminated holiday window display ornament formed by a ring frame having ornamentation including LED lights attached to one side with support stanchions projecting through the ornamentation and having glass panel attaching suction cups at the ends thereof. A housing at the bottom of the frame contains a battery compartment, on/off switch and music sounding chip and speaker.

8 Claims, 3 Drawing Sheets

ILLUMINATED WINDOW DISPLAY ORNAMENT

BACKGROUND OF THE INVENTION

This invention concerns ornaments and more particularly an illuminated holiday ornament adapted for window display. Holiday ornaments such as Christmas wreaths are typically hung on walls and the exterior of doors for display during the holiday season by the use of a fastener driven into the surface of the wall or door.

Strings of lights are sometimes also utilized requiring the use of extension cords and the like limiting the locations where the wreath may be displayed and also complicating the hanging.

Christmas wreaths are sometimes hung in front of windows for display requiring the use of wires to suspend the same in front of the window, or some other inconvenient mounting arrangement.

It would be advantageous to simplify the mounting arrangements for display in windows, both for private enjoyment and/or commercial use. It would also be advantageous to be able to mount such ornaments in the windows of moving vehicles, which presents a more difficult problem than glassed windows in stationary buildings in that the mounting arrangement must be secure enough to withstand the forces generated as the vehicle is driven around corners and over bumpy streets. The absence in auto interiors of wood framing members to provide convenient mounting structure also presents difficulties as does the powering of lights associated with wreaths.

U.S. Pat. No. 5,016,145 describes an illuminated display for use in vehicle windows. The display in this instance is limited to a greeting message and also requires a cumbersome power cord arrangement plugged into the vehicle cigarette lighter. An indirect illumination method is employed, requiring a bulb requiring significant electrical power.

See also U.S. Pat. No. 4,965,705 which does describe an LED ornament pin for personal wear which is battery powered, but is not contemplated being used as a window display ornament.

Accordingly the object of the present invention is to provide an illuminated window display holiday ornament such as a Christmas wreath which is adapted for convenient mounting on windows both in buildings and vehicles.

SUMMARY OF THE INVENTION

The present invention comprises a window display ornament consisting of a rigid ornament frame providing an outline of the ornament shape, i.e, a ring for a Christmas wreath, in which ornamentation such as artificial evergreen foliage is attached to one side of the frame so as to cover the one side of the frame and create a wreath appearance on the one frame side. The one side of the ornament frame also has a pair of support stanchions which project through the artificial evergreen foliage to a point forward of the ornamentation. A glass attachment means such as a suction cup is carried at the end of each of the support stanchions, adapted to be directly secured to the window surface on which the ornament is to be mounted. The mounting frame is preferably slotted and receives wire leads for a series of LED lights utilized to illuminate the wreath. The wire leads extend to a housing attached to the bottom of the opposite side of the frame from that on which the ornamental material is secured.

The housing forms a battery compartment for batteries utilized to power the LED lights and an associated on/off switch an audio output computer chip and mini speaker may also be mounted within the housing which when activated will play music such as holiday tunes.

The ornament is thus self contained both as to the mounting of the ornament and the powering of the LED lights and the musical device, enabling very convenient installation on a window surface.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
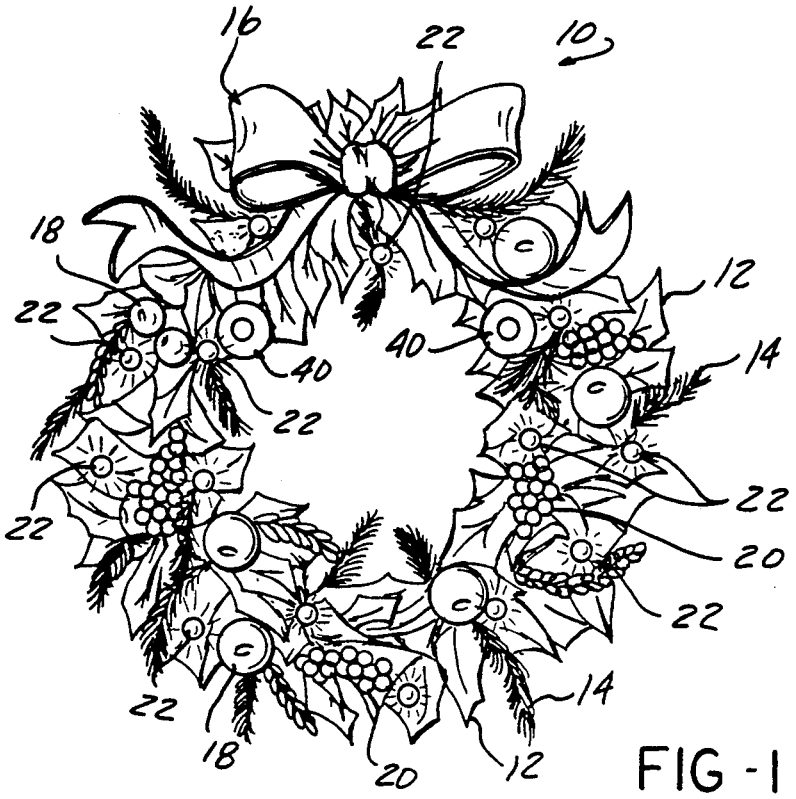
FIG. 1 is a front view of a window display ornament according to the present invention.

Referring to the drawings, FIG. 1 illustrates a frontal view of the ornament 10 according to the present invention which comprises a Christmas wreath having formed a ring arrangement of artificial evergreen foliage such as holly leaves 12 and needled branches 14 which may be embellished with a ribbon 16, holly berries 18, pine cones 20, etc.

A series of LED lights 22 is arranged around the wreath within the artificial evergreen foliage 12 and 14.

Figure 2:
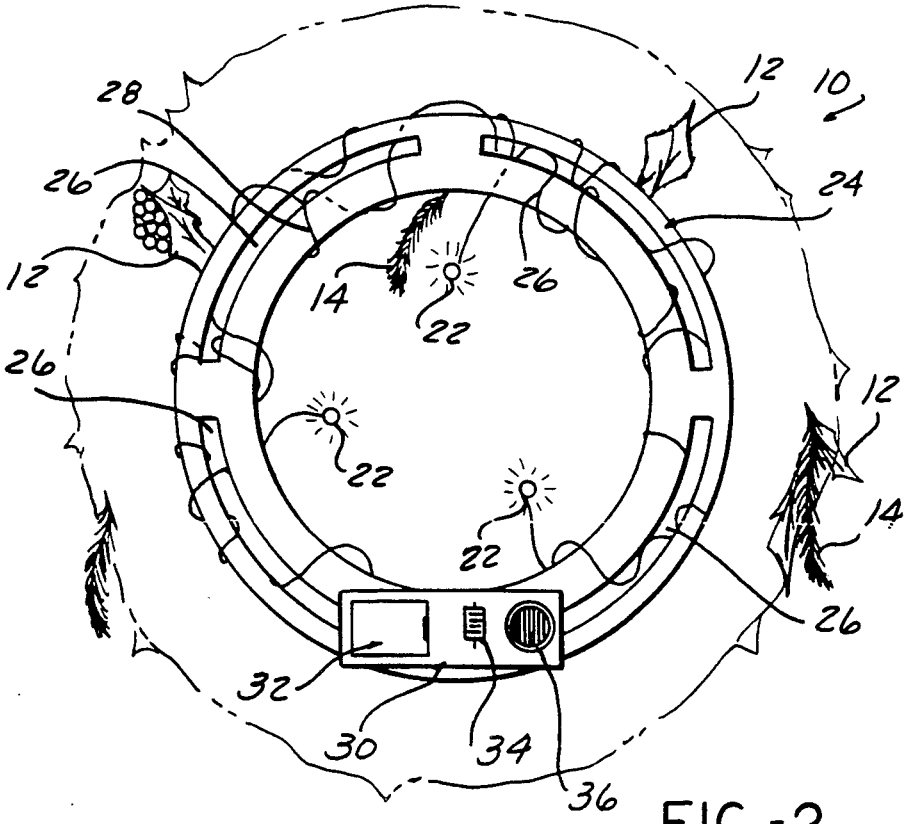
FIG. 2 is a rear view of the ornament shown in FIG. 1.

Referring to FIG. 2, the ornament 10 is formed with a rigid, generally planar ornament frame 24 defining the ornament shape, here taking the form of a rigid ring formed with slots 26. The ornamentation comprised of the artificial evergreen foliage comprised of leaves 12 and needled fronds 14 is mounted to one side of the frame, the opposite side not shown in FIG. 2. A wire lead 26 for the LED lights 22 is interwoven into the slots 26. Various other ornamentation may also be secured by means of wires 28 attached to the leaves 12 and fronds 14.

A housing 30 is located at the bottom and at the rear of the ornament frame 24 which has a battery compartment 32 to provide self contained power for the LED lights 22. An on/off switch 34 also is mounted in the housing 30 for controlling power to the LED circuit.

The ornament 10 is preferably also equipped with a suitable music generating chip also contained within the housing 32 with a miniature speaker 36. Thus the ornament 10 may also play seasonal songs at the same time that the LED lights 22 are illuminated either in steady or blinking fashion.

Figure 3:
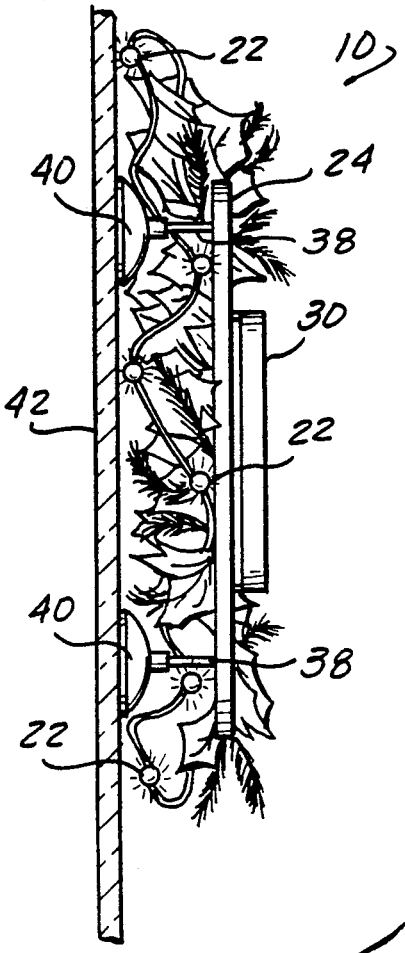
FIG. 3 is a top view of the ornament shown in FIGS. 1 and 2 with a sectional view of adjacent glass surface to which the ornament is attached.

Referring to FIG. 3, the frame 24 is provided with a pair of support stanchions 38 which project from the frame 24 on the same side on which the ornamentation is mounted, with a suitable glass panel attachment means, comprised of suction cups 40 at a point just clear of the ornamentation such as to be able to be pressed against the surface of a glass pane 42 to secure the ornament 10 thereto. Other mounting means could include a suitable pressure adhesive or Velcro patches.

Accordingly, a self contained ornament both as to the mounting of the ornament and powering of the illumination is provided by a relatively simple and inexpensive design.

Figure 4:
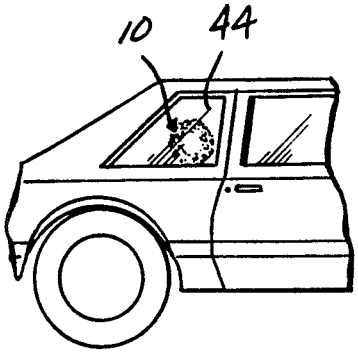
FIG. 4 is a side view of an automobile illustrating the installation of the ornament according to the present invention on one of the vehicle windows.

The mounting provides a secure attachment such that as shown in FIG. 4, such that automobile windows 44 may be decorated in a very convenient and reliable manner.

Figure 5:
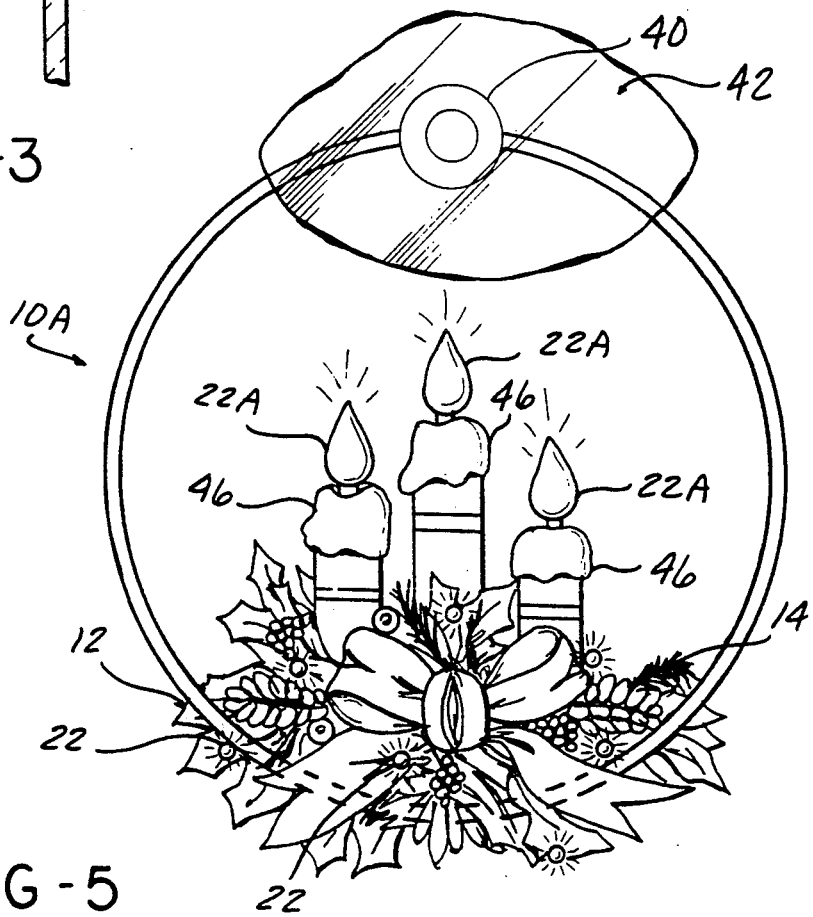
FIG. 5 is a front view of a variation of the ornament according to the present invention.

Referring to FIG. 5, the frame 24A may comprise a hoop, with the ornamentation 12, 14, and the LED lights 22 concentrated at the bottom segment and supplemented with an arrangement of candles 46 added with the LEDs 22 associated therewith to simulate candle flames.

A single suction cup 42 is mounted at the high point of the hoop 24.

Figure 6:
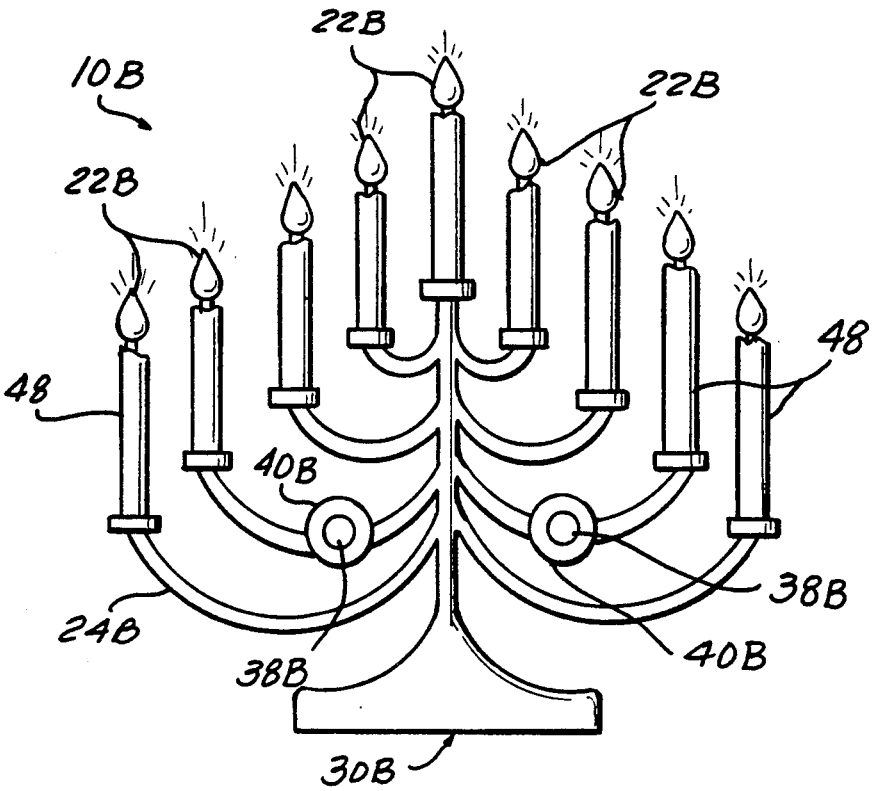
FIG. 6 is a front view of another variation of the ornament according to the present invention.
Figure 7:
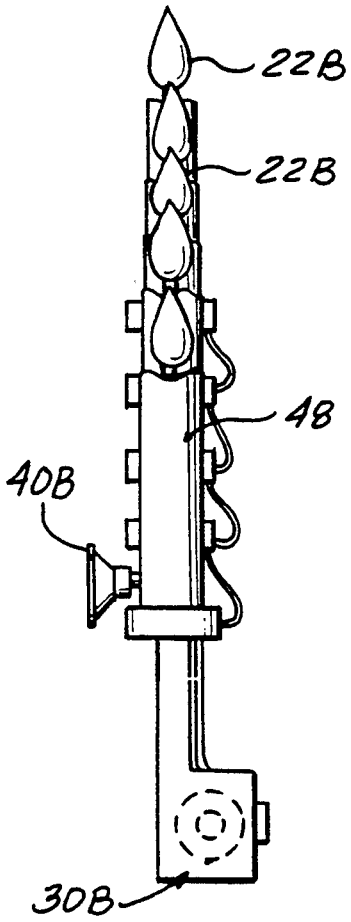
FIG. 7 is a side view of the ornament shown in FIG. 6.

Referring to FIGS. 6 and 7, yet another form of the ornament 10B is shown. In this instance the frame 24B is in the form of a menorah providing support for a plurality of artificial candles 48 with the LED's 22B providing simulated candle flames.

The suction cups 48, are provided on support stanchions 38B secured to arms of the frame 24B. The housing 30B forms a base for the menorah.

I claim:

1. An illuminated holiday window display ornament comprising:

a generally planar rigid frame defining the outline of said ornament;

ornamentation attached to one side of said frame including a series of LED lights connected to an electrical lead extending about said frame;

at least one support stanchion attached to said one side of said frame and projecting normally therefrom;

glass attachment means carried by said support stanchion adapted to attach said frame to a glass pane;

a housing attached to said frame, said housing including a battery compartment containing batteries for powering said LED lights.

2. The ornament according to claim 1 wherein said frame comprises a ring member and said ornamentation includes artificial evergreen foliage attached to said one side of said frame.

3. The ornament according to claim 2 wherein said artificial evergreen foliage extends completely around said frame to form a wreath and wherein a pair of support stanchions are provided on either side of said frame projecting through said ornamentation.

4. The ornament according to claim 3 wherein said glass attachment means comprise suction cups.

5. The ornament according to claim 3 wherein said ring member is slotted and said wire leads are interwoven therethrough.

6. The ornament according to claim 1 further including a music generating means contained in said housing, producing a musical playback when activated, and a switch on said housing selectively controlling energization of said music generating means and said LED lights.

7. The ornament according to claim 1 wherein said frame is shaped as a menorah having arms with ornamental candles attached and said LED lights located to provide an artificial candle flame for each ornamental candle, said housing defining a menorah base.

8. The ornament according to claim 1 wherein said frame member comprises a hoop and said ornamentation comprises artificial evergreen foliage attached at the bottom of said hoop.

* * * * *